US005377973A

United States Patent [19]

Jones et al.

[11] Patent Number: 5,377,973

[45] Date of Patent: Jan. 3, 1995

[54] METHODS AND APPARATUS FOR PLAYING CASINO CARD GAMES INCLUDING A PROGRESSIVE JACKPOT

[75] Inventors: Daniel A. Jones, Las Vegas, Nev.; Mark W. Duron, Ft. Lauderdale, Fla.

[73] Assignee: D&D Gaming Patents, Inc., Pompano Beach, Fla.

[21] Appl. No.: 195,482

[22] Filed: Feb. 14, 1994

Related U.S. Application Data

[60] Continuation-in-part of Ser. No. 140,688, Oct. 21, 1993, Ser. No. 40,925, Mar. 31, 1993, Ser. No. 74,301, Jun. 9, 1993, and Ser. No. 88,785, Jul. 8, 1993, each , said Ser. No. 40,925, said Ser. No. 74,301, said Ser. No. 88,785, is a continuation-in-part of Ser. No. 800,631, Nov. 27, 1991, Pat. No. 5,288,077, said Ser. No. 140,688, is a continuation-in-part of Ser. No. 74,301, Jun. 9, 1993, which is a continuation-in-part of Ser. No. 800,631, Jun. 9, 1993, which is a continuation-in-part of Ser. No. 361,276, Jun. 5, 1989, Pat. No. 5,078,405, which is a division of Ser. No. 214,934, Jul. 5, 1988, Pat. No. 4,861,041, which is a continuation-in-part of Ser. No. 182,374, Apr. 18, 1988, Pat. No. 4,863,553.

[51] Int. Cl.[6] ..... A63F 1/00

[52] U.S. Cl. ..... 273/85C P; 273/292; 273/309

[58] Field of Search ..... 273/292, 274, 309, 85 CP

[56] References Cited

U.S. PATENT DOCUMENTS

| | | | |
|---|---|---|---|
| 1,238,736 | 9/1917 | Barrett | 453/18 |
| 1,527,929 | 2/1925 | Simons | 273/274 |
| 1,763,476 | 6/1930 | Morris | 273/309 |
| 1,970,876 | 8/1934 | Anderson | 273/309 |
| 2,008,829 | 7/1935 | Israel | 273/148 A |
| 2,199,745 | 5/1940 | Harris | 273/309 |
| 3,011,789 | 12/1961 | Eliassen et al. | 273/274 |
| 3,269,503 | 8/1966 | Foster | 273/856 P |
| 3,556,531 | 1/1971 | Elder | 273/143 R |
| 3,663,021 | 5/1972 | Whippo | 273/138 A |
| 3,667,757 | 6/1972 | Holmberg | 273/274 |
| 3,689,071 | 9/1972 | Kucera | 273/292 |
| 3,796,433 | 3/1974 | Fraley et al. | 273/138 A |
| 3,825,255 | 7/1974 | Kennard et al. | 273/139 |
| 3,876,208 | 4/1975 | Wachtler et al. | 273/138 A |
| 4,063,680 | 12/1977 | Leo | 232/1 D |

(List continued on next page.)

FOREIGN PATENT DOCUMENTS

| | | |
|---|---|---|
| 338644 | 10/1989 | European Pat. Off. . |
| 2830216 | 1/1980 | Germany . |
| 3003376 | 8/1981 | Germany . |
| 135187 | 6/1988 | Japan . |

(List continued on next page.)

OTHER PUBLICATIONS

Winning Gamer, Issue #17, Feb. 1986 Pi Yee Press, LaJolla, Calif.

Winning Gamer, Issue #19, Apr. 1986 Pi Yee Press, LaJolla, Calif.

Winning Gamer, Issue #20, May 1986 Pi Yee Press, LaJolla, Calif.

(List continued on next page.)

*Primary Examiner*—Benjamin H. Layno

[57] ABSTRACT

Methods and apparatus for allowing gamblers playing either live casino table game or electronic video device versions of card games allow the players the options of (1) making wagers in both the underlying card game and a progressive jackpot component, (2) making wagers only in the underlying card game, and (3) making a wager only in the progressive jackpot component. In the live table version, a player may activate an indicator light or place a special token in the bet box for the underlying game to signal that the player opts to participate only in the progressive jackpot component. In the electronic video device version, a player activates one or more push buttons to select one of the three operational modes. The underlying card game preferably comprises Twenty-One or a five-card stud poker variant known as Caribbean Stud TM poker, but may also comprise other card games such as five card stud, seven card stud, Jacks or better, etc.

20 Claims, 3 Drawing Sheets

U.S. PATENT DOCUMENTS

| | | | |
|---|---|---|---|
| 4,099,722 | 7/1978 | Rodesch et al. | 273/143 R |
| 4,232,866 | 11/1980 | Pennachio | 273/374 |
| 4,302,012 | 11/1981 | Giovanni et al. | 273/148 R |
| 4,305,586 | 12/1981 | Richards | 273/274 |
| 4,364,567 | 12/1982 | Gootl | 273/237 |
| 4,397,469 | 8/1983 | Carter, III | 273/149 R |
| 4,518,001 | 5/1985 | Branham | 133/5 R |
| 4,531,187 | 7/1985 | Uhland | 364/412 |
| 4,575,085 | 9/1986 | Olington | 273/138 R |
| 4,614,342 | 9/1986 | Takashima | 273/85 CP |
| 4,624,459 | 11/1986 | Kaufman | 273/143 R |
| 4,648,604 | 3/1987 | Horan | 273/292 |
| 4,651,997 | 3/1987 | Wood | 273/274 |
| 4,700,948 | 10/1987 | Okada | 273/143 R |
| 4,721,307 | 1/1988 | Okada | 273/143 R |
| 4,743,022 | 5/1988 | Wood | 273/85 CP |
| 4,756,531 | 7/1988 | DiRe et al. | 273/138 A |
| 4,759,549 | 7/1988 | Beckwith | 273/274 |
| 4,760,527 | 7/1988 | Sidley | 273/85 CP |
| 4,813,675 | 3/1989 | Greenwood | 273/138 A |
| 4,836,553 | 6/1989 | Suttle et al. | 273/292 |
| 4,837,728 | 6/1989 | Barrie et al. | 364/412 |
| 4,861,041 | 8/1989 | Jones et al. | 273/292 |
| 4,948,134 | 8/1990 | Suttle et al. | 273/85 CP |
| 4,964,638 | 10/1990 | Ishida | 273/138 A |
| 5,022,653 | 6/1991 | Suttle et al. | 273/85 CP |
| 5,042,818 | 8/1991 | Weingardt | 273/292 |
| 5,078,405 | 1/1992 | Jones et al. | 273/309 |
| 5,112,060 | 5/1992 | Jones | 273/309 |
| 5,249,800 | 10/1993 | Hilgendorf et al. | 273/85 CP |

FOREIGN PATENT DOCUMENTS

| | | |
|---|---|---|
| 2097570 | 11/1982 | United Kingdom . |
| 2184029 | 6/1987 | United Kingdom . |

OTHER PUBLICATIONS

Winning Gamer, Issue #5, Feb. 1985 Pi Yee Press, LaJolla, Calif.

Winning Gamer, Issue #6, Mar. 1985 Pi Yee Press, LaJolla, Calif.

Winning Gamer, Issue #15, Dec. 1985 Pi Yee Press, LaJolla, Calif.

Winning Gamer, Issue #21, Jun. 1986 Pi Yee Press, LaJolla, Calif.

Casino Player, vol. IV, No. 12, Aug. 1993, "My Biggest Slot Jackpot" Stanford Wong.

Affidavit Of Nick Edward Greenwood Nov. 23, 1993.

Affidavit Of Michael Spencer Stone Nov. 23, 1993.

Affidavit Of William Randall Adams Oct. 4, 1993.

Affidavit Of John F. Acres Oct. 4, 1993.

Affidavit Of Terry Oliver Nov. 22, 1993.

Affidavit Of Derell Johns Nov. 19, 1993.

Casino Journal, vol. 8, No. 12, Dec. 1992 "Working Within The Systems: IGT's linked progressive programs take leap to the tables" pp. 10–15, 40, 41.

Casino Gaming, Sep. 1988, pp. 12–13 "Aruba Deals A New Game: Caribbean Stud Poker".

State of New Jersey Casino Control Commission PRN 217205 Civil Action IGT's.

Second Amended Petition For The Authorization For The Implementation Of The Game Of Progressive–21 filed some time after Aug. 4, 1992.

Information Disclosure Statement, Apr. 7, 1988 Describing "Sklansky's Casino Poker" and Video Poker.

Coin Hopper Model CH–500 and Model Number DH–750/UI literature Asahi Seiko 26 Jan. 1993.

Statement Of Grounds And Particulars by John Huxley Ltd In opposition to Australian–Patent Application No. 628044.

Casino Journal, vol. 8, No. 6, Jun. 1993 "So you wanna be a gambler" pp. 1, 5.

C. J. Bover, Las Vegas Review–Journal, "Gamblers Take Chance At Million Dollar Payoff" Feb. 26, 1983 pp. 1E–2E.

W. B. Gibson, Hoyle's Modern Encylopedia of Card Games, 218–19, 369–70, (1974).

J. Scarne, Scarne's Encyclopedia of Card Games, 299–304, 383 (1983).

J. Scarne, Scarne's New Complete Guide to Gambling, 440–45 (1974).

Scarne, Scarne's Encyclopedia of Games, Harper & Row, N.Y., Copyright 1973, p. 381 and title pages.

METHODS AND APPARATUS FOR PLAYING CASINO CARD GAMES INCLUDING A PROGRESSIVE JACKPOT

CROSS REFERENCE TO RELATED APPLICATIONS

This application is a continuation-in-part of application Ser. No. 08/140,688, filed Oct. 21, 1993; which is a continuation-in-part of application Ser. No. 08/074,301, filed Jun. 9, 1993; which is a continuation in part of application Ser. No. 07/800,631, filed Nov. 27, 1991, and now U.S. Pat. No. 5,288,077; which is a continuations-in-part of application Ser. No. 07/361,276, filed Jun. 5, 1989 and now U.S. Pat. No. 5,078,405; which is a division of application Ser. No. 07/214,934, filed Jul. 5, 1988 and now U.S. Pat. No. 4,861,041; which is a continuation-in-part of application Ser. No. 07/182,374, filed Apr. 18, 1988 and now U.S. Pat. No. 4,863,553. This application is also a continuation-in-part of application Ser. No. 08/040,925, filed Mar. 31, 1993, application Ser. No. 08/074,301, filed Jun. 9, 1993, and application Ser. No. 08/088,785, filed Jul. 8, 1993, each of which are continuations-in-part of the above referenced application Ser. No. 07/800,631, filed Nov. 27, 1991 and now U.S. Pat. No. 5,288,077. The entire disclosures of each of the above referenced applications and patents are hereby incorporated by reference herein.

BACKGROUND OF THE INVENTION

The present invention generally relates to casino card games including progressive jackpots. More particularly, it relates to methods and apparatus for playing electronic and live table versions of casino card games, particularly Twenty-One and a proprietary five-card stud poker variant known as Caribbean Stud TM poker, including an optional progressive jackpot feature.

DESCRIPTION OF RELATED PATENTS

The following discussion generally describes the subject matter of patents which issued on earlier filed applications each naming as an inventor Daniel A. Jones, one of the two inventors named in the instant application. This discussion does not constitute an admission that any of the hereinafter described subject matter constitutes prior art with respect to the instant application.

U.S. Patent Nos. 4,861,041, 4,948,134, 5,022,653, and 5,078,405 disclose the provision of an optional progressive jackpot to both electronic and live table versions of Caribbean Stud TM poker and Twenty-One. However, in the methods and apparatus disclosed in these patents, players must participate in the underlying game in order to participate in the progressive jackpot feature. In the case of the electronic poker machine variant, this involves making separate wagers for the underlying game and for the progressive jackpot by inserting tokens or coins, and also requires the dealing and comparison of both dealer and player hands. However, many gamblers that like to place relatively small wagers affording a small chance of winning a very large jackpot do not particularly like to participate in wagers which offer a smaller payoff amount, even those offering much greater chances of winning. Accordingly, the necessity of understanding the rules and strategy of the underlying card game might deter some individuals from participating, even though such individuals generally relish the possibility of participating in the progressive jackpot feature.

Additionally, particularly in the electronic version, the completion of the underlying game including dealing and comparing both dealer and player hands, and allowing the player to decide wagering options in the play of the underlying game as well as in the progressive jackpot, can result in a relatively slow rate of play. In addition to annoying and frustrating the player, this also results in lost revenue to the casino. According to well understood principles of casino management, various games of chance (and skill) which constitute the game mix of a particular casino offer various different theoretical casino "win" percentages, based upon optimal player strategy. Gamblers have access to a large body of literature with respect to the theory of typical casino games, and additionally receive information from their more theoretically minded fellow gamblers. Thus, many gamblers shun games with low theoretical return rates, even when those rates fall within established minimums set by gaming commissions.

Accordingly, since both gaming commissions and player response constrains the casino to operate games within a certain range of "win" percentages, casinos must seek other means to increase their revenues. Thus, casinos seek to implement the most popular games and also seek to accelerate the rate of play for a particular game. Even modest increases in the rate of play for a particular game can result in a substantial increase in casino revenues and profits, without altering the theoretical "win" percentages.

These same rationales apply to both electronic video card gaming devices and to live table card games. Additionally, many players that might otherwise participate in live casino card games are intimidated by their relative lack of knowledge relative to other more experienced players.

BRIEF SUMMARY OF THE INVENTION

Accordingly, in order to provide greater player option and thus increase participation, the present invention provides a method and apparatus for allowing players to participate, in both electronic and live table versions, by placing a wager in only the progressive jackpot feature of casino card games such as Caribbean Stud TM poker and Twenty-One, without participating by placing a wager in the underlying game. The invention may also be employed in connection with other card games such as five card stud, seven card stud, Jacks or better, etc.

More specifically, the electronic version utilizes a video display terminal similar to a slot machine or a video poker game. The player inserts one or more gaming tokens into a coin acceptor, and then manipulates one or more control buttons to select whether the player will participate in the underlying game only, the underlying game and the progressive jackpot, or only the progressive jackpot. If the player selects the underlying game only wagering option or the underlying game and jackpot wagering option, the electronic device "deals" and compares both dealer and player hands to determine the winner in the underlying game and optionally the progressive jackpot. If the player selects the jackpot only wagering option, the device "deals" only a player hand and compares the player hand with certain predetermined winning card arrangements and makes appropriate payoffs.

In live table variants, a plurality of players each play against a human dealer. Each player has the same three wagering options: underlying game only, game and jackpot, and jackpot only. The present invention contemplates several different methods by which a player might indicate his or her selected mode of play to the human dealer. If the player inserts a coin or token into the coin acceptor for the progressive jackpot, but does not place an initial wager in the betting box for the underlying game, then the dealer might assume that the player does not wish to participate in any wager for the underlying game, but does wish to participate in the progressive jackpot. Similarly, if the player places a wager in the bet box, but does not insert a token into the progressive jackpot coin acceptor, then the dealer assumes that the player wishes to participate in a wager only for the underlying game. If the player both places a wager in the bet box and inserts a token into the jackpot coin acceptor, then the player elects to participate in both the wagers for the underlying game and the progressive jackpot.

The present invention also contemplates the provision of other, more positive indicating means for jackpot only wagering option selection. For example, a player might push a button to activate an indicating light at the player's location by which the player might positively confirm the selection of the jackpot only option of play. Alternatively, each player might be provided with a "jackpot only" token for placement in the underlying game bet box in the event that the player wishes to participate in only the progressive jackpot.

DETAILED DESCRIPTION OF THE PREFERRED EMBODIMENTS

Figure 1:
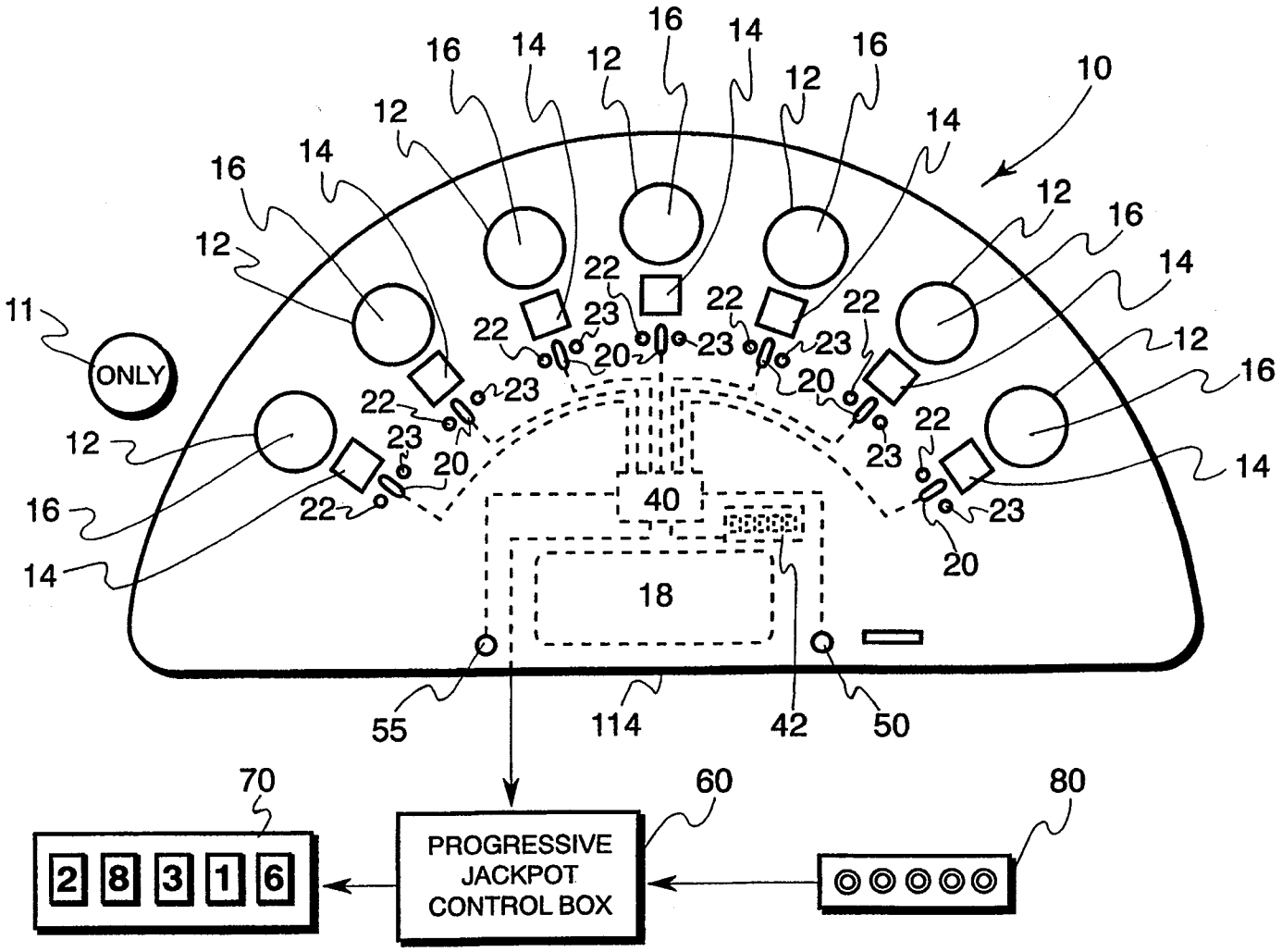
FIG. 1 shows an example apparatus for implementing the present invention in connection with a live casino table card game.

The live casino table game versions of Caribbean Stud TM poker game and the Twenty-One games of the present invention will be described with reference to the live casino game version table layout 10 shown in FIG. 1. The term "live casino game" is intended to encompass a game in which the house acts as the banker, the house collecting all losing wagers and paying all winning wagers. The dealer is employed by the house and each player plays exclusively against the house.

The layout 10 would be mounted for use on the top of a conventional gaming table (not shown) positioned at a suitable location in a casino. Playing locations 12 are provided for each player. Each playing location 12 preferably includes, in the case of Caribbean Stud TM poker, designated areas 14 and 16 for the player to make an "ante" and a "bet", respectively, which will be more fully explained herein, and as set forth in detail in U.S. Pat. No. 4,836,553, which issued on Jun. 6, 1989 to James P. Suttle and Daniel A. Jones, and which discloses in detail the manner of play of the five-card stud poker variant known as Caribbean Stud TM poker.

For use in a live casino table game version of Twenty-One, the layout 10 preferably includes betting zones and other indicia associated with well known conventional Twenty-One table layouts.

In both the live casino table game Caribbean Stud TM poker and Twenty-One versions, a dealer is positioned at a dealer location 114 adjacent a chip rack 18. Adjacent to each player is a coin acceptor 20. Each coin acceptor 20 is electronically connected to a main control board 40 to which is connected a number of odometer type counters 42 corresponding to the number of playing locations 12 provided on the gaming table 10. As shown in FIG. 1, seven playing locations 12 are preferably provided, although the number of playing locations can be more or less than seven. A reset switch 50 is located adjacent the dealer's location 114 and is electronically connected to the main control board 40 and provides a means whereby the dealer can reset the coin acceptors 20 prior to the beginning of the play of each hand. A lockout switch 55, is also provided adjacent to the dealers location 114 which is activated by the dealer to prevent late wagering as will be more fully explained herein.

The main control board 40 is electronically connected to a progressive jackpot control box 60 which receives the signals from each coin acceptor 20 and in response to those signals increments the progressive jackpot meter 70, as will be more full explained herein. Also electronically connected to the progressive control box 60 is the jackpot reset control 80 which provides means for resetting the amount shown on the progressive jackpot meter 70 whenever a player wins all, or part of, the amount shown on the progressive jackpot meter 70. The coin acceptor 20 "recognizes" that a gaming token has been placed therein and an indicator signal 22, preferably a light, adjacent to the coin acceptor 20 is activated showing that that particular player is participating in the progressive jackpot component of the game during the play of the hand. Besides activating the indicator signal 22, the coin acceptor 20 also sends an electronic signal to the main control board 40. This signal is sent by the main control board 40 to the odometer-type counter 42 corresponding to the particular playing location 12 to keep a sequential count of the number of gaming tokens that are placed in the particular coin acceptor 20.

The main control board 40 also activates the progressive jackpot control box 60 which in turn controls the progressive jackpot meter 70. Each gaming token placed in a coin acceptor 20 results in the amount shown on the progressive jackpot meter being increased by a predetermined amount. If, for example, each gaming token has a value of one dollar, then the amount shown on the progressive jackpot meter would be increased by any amount up to one dollar for each gaming token placed in a coin acceptor 20.

The construction and manner of operation of the progressive jackpot apparatus described above is as set forth in detail in U.S. Pat. Nos. 4,861,041 and 5,078,405.

According to the present invention, an indicating means is associated with each player location 12 to enable the player to indicate an election to participate in only the progressive jackpot feature, and not to participate in the wager associated with the underlying game (e.g., Caribbean Stud TM poker or Twenty-One). To this end, each playing location may include a combination push button and indicating light 23, such that player actuation of the button illuminates the light to signify to the dealer that the particular player wants to participate in only the jackpot portion of the game. Instead of a combination light and button, each player location 12 may include a separate button and light to allow a player to elect and indicate jackpot only mode participation. In the context of jackpot only mode play, the absence of the placement of any gaming token in the betting box or boxes for underlying game wagers, in combination with the insertion of a gaming token into coin acceptor 20, can also be employed to indicate a player option for jackpot only mode participation. As an alternative or additional means of indicating jackpot only mode election, each player location 12 may include a special indicating token 11. Placement of the special token 11 in the betting box 16, for example, would provide visual confirmation to the dealer that the player opts for jackpot only mode play. Additionally, the special "jackpot only" token 11 and the betting box 16 may include cooperating sensing elements such that placement of the token 11 within the boundaries of the betting box 16 provides an electric indicating signal. This signal may be employed through appropriate circuitry to activate a visual or audible signalling device, such as indicator light 23.

When each player has had a reasonable opportunity to elect one of the three modes of play and to make a progressive jackpot wager, the dealer activates lockout switch 55 which deactivates each coin acceptor 20. Any tokens placed in a coin acceptor 20 after lockout switch 55 is activated will not register. This prevents late wagering after the cards are dealt.

The amount shown on the progressive jackpot meter will continue to increase for each gaming token wagered until a player achieves a winning hand. Preselected winning hands earn a player all or part of the amount shown on the progressive jackpot meter.

In a preferred embodiment of the present invention when the underlying game is Twenty-One and uses any number of decks of conventional playing cards (from one deck to as many decks as the house desires to include in the game) which are then shuffled together, the preselected winning hands in a Twenty-One game are as follows:

TABLE 1

| Winning Hand | Amount of Jackpot |
|---|---|
| Ace, 2, 3, 4 and 5 suited | highest amount |
| 2, 3, 4 and 5 suited | second highest amount |
| 4, 5 and 6 suited | third highest amount |

The amounts paid for the various winning hands are not critical but should be determined based on conventional percentage controls methods so that the house maintains a reasonable profit from the operation of the game. In most regulated gaming jurisdictions, the house percentage should not exceed 15% on a theoretical hold basis.

As an additional modification to this preferred embodiment, two additional preselected winning hands and payoff amounts may be added to this schedule:

TABLE 2

| Additional Winning Hands | Amount of Jackpot |
|---|---|
| Any Blackjack suited | sixth highest amount |
| Any Blackjack unsuited | seventh highest amount |

As used in this Table 2, "Blackjack" means a two card hand having an Ace and a ten count card (King, Queen, Jack or 10).

In a more preferred embodiment of the present invention when the Twenty-One game uses any number of decks of conventional playing cards (from one deck to as many decks as the house desires to include in the game) which are then shuffled together, the preselected winning hands and payoff amounts in a Twenty-One fame are as follows:

TABLE 3

| Winning Hand | Amount of Jackpot |
|---|---|
| Ace, 2, 3, 4 and 5 suited | 100% |
| 2, 3, 4 and 5 suited | 2500 tokens |
| 4, 5 and 6 suited | 100 tokens |
| 4, 5 and 6 unsuited | 100 tokens |
| Ace and Jack suited | 50 tokens |

As used in this Table 3, "suited" means that each of the designated cards must be of the same card suit—Spades, Hearts, Diamonds or Clubs. "Unsuited" means that the suit of the card is not relevant to determining whether a winning hand has been achieved; cards of the same suit or cards of different suits are equally eligible in the winning hand.

As an additional modification to this more preferred embodiment, two additional preselected winning hands and payoff amounts may be added to this schedule:

TABLE 4

| Additional Winning Hands | Amount of Jackpot |
|---|---|
| Any Blackjack suited | 10 tokens |
| Any Blackjack unsuited | 2 tokens |

As used in this Table 4, "Blackjack" means a two card hand having an Ace and a ten count card (King, Queen, Jack or 10).

It has become popular to use six decks of standard playing cards, all shuffled together, and held in a card holding device known as a "shoe." In a preferred embodiment of the present invention when the Twenty-One game uses six decks of conventional playing cards shuffled together and held in a shoe, the preselected winning hands in a Twenty-One game are as follows:

TABLE 5

| Winning Hand | Amount of Jackpot |
|---|---|
| Five 3's unsuited | highest amount |
| Three 5's suited | second highest amount |
| Four, Five and Six suited | third highest amount |
| Four, Five and Six unsuited | fourth highest amount |
| Ace and Jack suited | fifth highest amount |

As used in this Table 5, "suited" means that each of the designated cards must be of the same card suit—Spades, Hearts, Diamonds or Clubs. "Unsuited" means that the suit of the card is not relevant to determining whether a winning hand has been achieved; cards of the same suit or cards of different suits are equally eligible in the winning hand.

The amounts paid for the various winning hands are not critical but should be determined based on conventional percentage controls methods so that the house maintains a reasonable profit from the operation of the game. In most regulated gaming jurisdictions, the house percentage should not exceed 15% on a theoretical hold basis.

In a more preferred embodiment of the present invention when the Twenty-One game uses six decks of conventional playing cards shuffled together and held in a shoe, the preselected winning hands and payoff amounts in a Twenty-One game are as follows:

TABLE 6

| Winning Hand | Amount of Jackpot |
|---|---|
| Five 3's unsuited | 100% |
| Three 5's suited | 2500 tokens |
| Four, Five and Six suited | 100 tokens |
| Four, Five and Six unsuited | 100 tokens |
| Ace and Jack suited | 50 tokens |

As used in this Table 6, "suited" means that each of the designated cards must be of the same card suit—Spades, Hearts, Diamonds or Clubs. "Unsuited" means that the suit of the card is not relevant to determining whether a winning hand has been achieved; cards of the same suit or cards of different suits are equally eligible in the winning hand.

If the underlying card game is Caribbean Stud TM poker, the preferred predetermined winning card arrangements and associated payoff amounts are as set forth below:

TABLE 7

| Winning Hand | Amount of Jackpot |
|---|---|
| Royal Flush | 100% |
| Straight Flush | 10% |
| Four of a Kind | 1% |
| Full House | 50 tokens |
| Flush | 25 tokens |

As set forth in U.S. Pat. No. 4,836,553, standard playing cards are used to play the Caribbean Stud TM poker game. Any number of decks of cards may be used, but in the preferred embodiment, a single deck of standard playing cards is used which is reshuffled after each round is played. The dealer shuffles the cards, each player makes an ante by placing a token or chip in the ante area 14 and then the dealer deals one card at a time to each player and then one card to himself until each player and the dealer has a five card hand. All of each player's cards are dealt face down, while four of the dealer's cards are dealt face down and the other card face up.

Each player may look at his five card hand and each player then decides whether his five card hand has a favorable probability of ultimately beating the dealer's five card hand. The player is assisted in this determination because the player can see one of the dealer's cards.

The priority of winning hands is determined by the conventional rules of poker. As is known to those skilled in the art, five card poker hands are ranked according to the following order with a Royal Flush being the highest winning hand: 1. Royal Flush 2. Straight Flush 3. Four of a Kind 4. Full House 5. Flush 6. Straight 7. Three of a Kind 8. Two Pair 9. One Pair 10. High Card in Hand If a player determines that his hand will not beat the dealer's hand, the player folds or drops, i.e., discontinues playing that hand. The dealer wins the player's ante and takes the player's token from the ante area 14 on the playing surface 10 and places it in the chip rack 22.

If the player determines that his hand may beat the dealer's hand, then the player indicates his willingness to continue play by placing a bet in the bet area 16 on the playing surface 10. The bet made by the player is preferably equal to a multiple (e.g., double) of whatever the player originally anted.

After each player has either bet or folded, all cards are turned face up. Each remaining player places his five card hand in front of him on the playing surface 10 while the dealer's cards are all turned face up in front of the dealer on the playing surface 10.

If the dealer does not have a poker hand at least equal to a predetermined rank or minimum play level, e.g., an Ace-King combination or better, the game does not go forward, and the dealer pays each remaining player a predetermined amount, e.g., one-to-one odds on the amount of the player's ante. The amount of the player's bet is simply returned to the player. All cards are collected, the dealer shuffles the cards and the next round can be played.

If the dealer has a poker hand of at least the preselected rank or minimum (Ace-King or better), then play proceeds and each remaining player's hand is compared to the dealer's hand. If the dealer's hand is higher based on the conventional priority or ranking of five card poker hands, then the dealer wins and he collects both the player's ante and bet. If the dealer's and player's hands are equal, the hand is ruled a tie and the player keeps his bet and his ante.

If the player's hand is higher, the player wins and the dealer pays the player a first predetermined amount, e.g., one-to-one odds, on the amount of the player's ante regardless of the type of poker hand the player has. The dealer also pays the winning player a second predetermined amount, e.g., one-to-one odds on his bet unless the player has received a hand which exceeds a minimum win level, in which case, instead of paying one-to-one odds, the dealer pays the player a bonus payment on the amount of the player's bet based on the type of poker hand that the player has. The bonus payment may be paid according to the following preferred bonus payment schedule:

TABLE 8

| Type of Hand | Bonus Payment Odds |
|---|---|
| Royal Flush | 250-to-1 |
| Straight Flush | 50-to-1 |
| Four of a Kind | 20-to-1 |
| Full House | 7-to-1 |
| Flush | 5-to-1 |
| Straight | 4-to-1 |
| Three of a Kind | 3-to-1 |
| Two Pair | 2-to-1 |

After the dealer has paid the winning players and collected from the losing players, the cards are gathered up, the dealer shuffles the cards and the next round can be played. While the bonus payment odds in the above table are a preferred example of a payout schedule, different odds can be used within the spirit of the invention.

Figure 2:
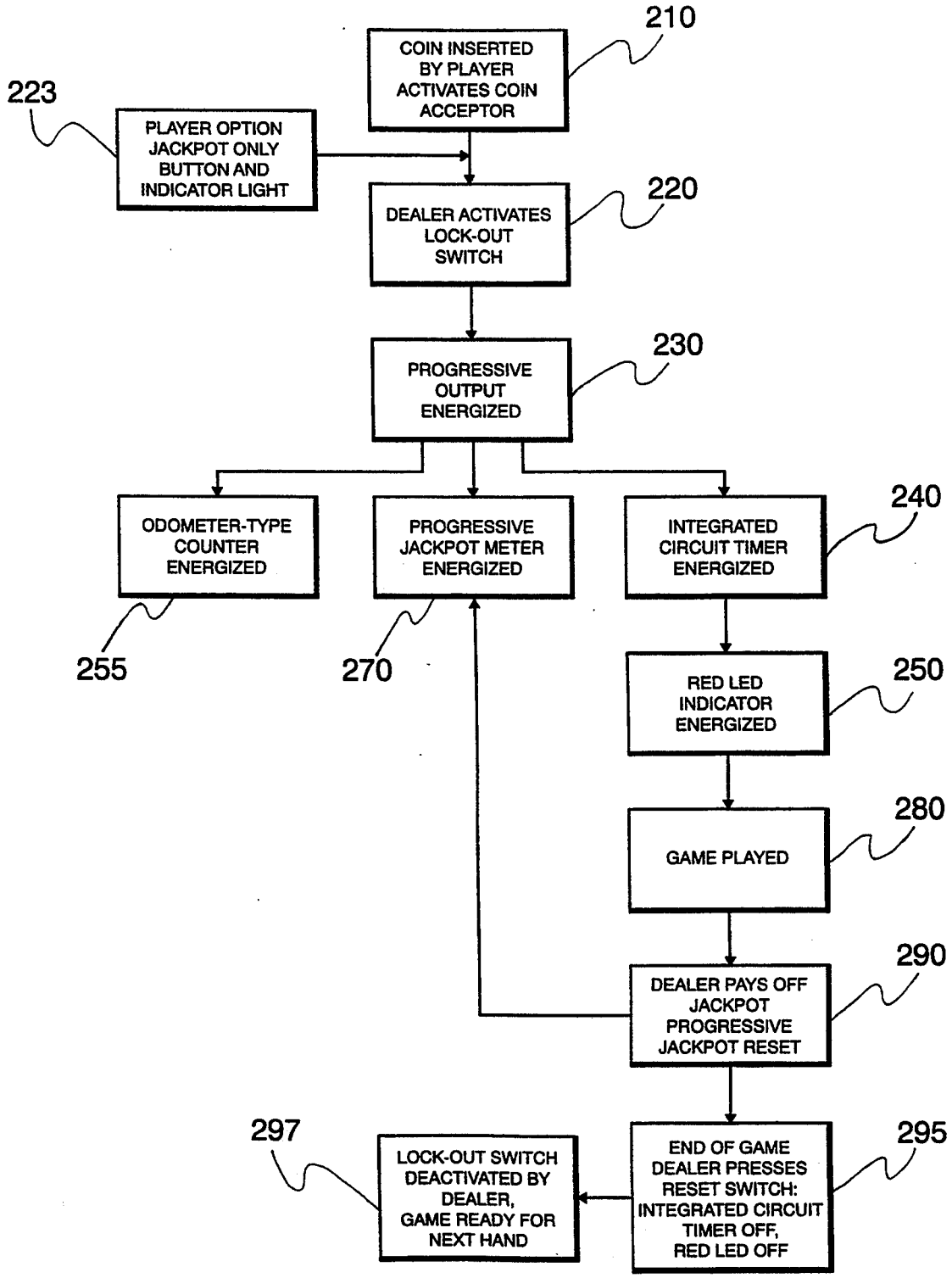
FIG. 2 show a block diagram of the manner of play of the live casino table card game variant of the present invention.

FIG. 2 shows in block diagram form the method of play and operation of the present invention. Each playing location has a coin acceptor 210 into which a player places a gaming token in order to be eligible for the progressive jackpot amount. Each playing location may optionally also include an indicating means 223, such as a push button and light, by which a player may make a positive indication of an election to participate in only the progressive jackpot component of the game. When all players have had sufficient time to decide whether to participate in the progressive jackpot only, the underlying game only, or the underlying game and the progressive jackpot, for that hand, the dealer activates the lockout switch 220 which prevents late wagers. Each gaming token placed in a coin acceptor 210 energizes the progressive output control 230 which in turn activates three separate devices. An integrated circuit timer is energized which causes an indicator light 250 to be illuminated at the location on the coin acceptor in front of the player. This gives a visual indication to the dealer that that player is participating in the progressive jackpot during the play of that hand.

The signal from the progressive jackpot control 230 also activates an odometer-type counter 255 which increments by one unit for each gaming token wagered through the coin acceptor. This allows the gaming establishment to keep an accurate count of the number of wagers made on the progressive jackpot.

The third signal from the progressive jackpot control 230 goes directly to the progressive jackpot meter 270. The progressive jackpot meter 270 shows the total amount available to be won by a player who obtains on of the preselected winning hands. The amount of the progressive jackpot meter 270 automatically increases a predetermined amount of each gaming token places in a coin acceptor. The progressive jackpot meter 270 is programmed to increase a specified percentage of the amount wagered in the coin acceptor 210.

The dealer then deals the cards to each player and the hand is played 280. If a player has a preselected winning hand, the player is paid the amount corresponding to the type of winning hand that the player has. The jackpot reset control 290 is manually activated which results in the amount of the payoff being automatically deducted from the amount displayed on the progressive jackpot meter 270.

After the winning players have been paid, the dealer activates the reset switch 295 which both turns off the integrated circuit timer 240 and turns off the indicator lights 223 (if any) and 250 and the dealer deactivates the lockout switch 297 thereby activating the coin acceptor 210 for the next hand.

Figure 3:
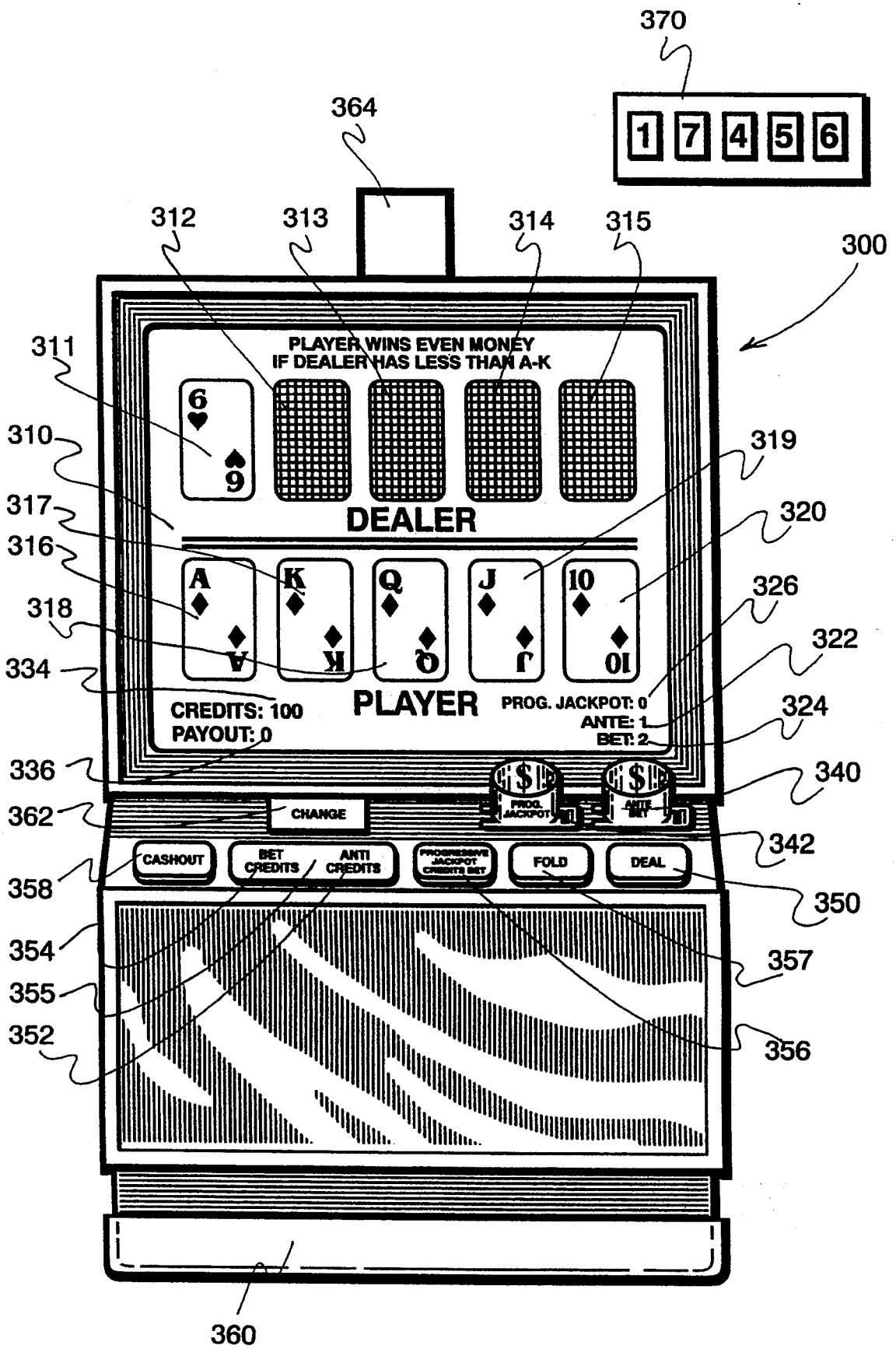
FIG. 3 shows an example electronic video machine for playing casino card games according to the present invention.

FIG. 3 shows an electronic video device 300 for playing both Caribbean Stud TM five-card stud variant poker and Twenty-One games according to another embodiment of the present invention. While the device is illustrated in connection with use for Caribbean Stud TM poker, the invention may also be readily adapted for use with electronic video Twenty-One games by providing suitable program modifications to conform the game to conventional Twenty-One game rules. The electronic device 300 is used to play the electronic version of the game. A video display screen 310 has the potential to display the five cards 311, 312, 313, 314 and 315 of the dealer's hands as well as the five cards 316, 317, 318, 319 and 320 of the player's hand. A LED display shows the number of coins "anted" 322 by the player and the number of coins "bet" 324 by the player. A progressive jackpot indicator light 326 is illuminated if the player is participating in the progressive jackpot component of the game. Another LED display shows the number of credits remaining 334 and the number of coins paid out 336. Two coin acceptors are provided; one for the ante/bet 340 and one for the progressive jackpot 342. Control Buttons are provided on the machine to operate the following functions: deal 350, ante credits 352, bet credits 354, progressive jackpot credits bet 356, fold 357 and cashout 358. The ante credits 352, bet credits 354 and progressive jackpot credits bet 356 buttons can be utilized whenever the player has credits 334 from previous winning hands. In the illustrated preferred embodiment, the ante credits and bet credits functions are preferably assigned to a single unitized control button 355. Alternatively, separate buttons might also be employed. The activation of the cash out button 358 causes gaming tokens to be dispensed from a hopper inside the machine (not shown) into the tray 360. The payout LED 336 will register the number of coins dispensed into the tray which is the number shown in the credits.

Whenever a player achieves a winning hand, the credits LED display 334 is incremented by the amount that the player has won. The winning player receives the same payoffs as those from the live gape. The game of the present invention is played electronically in a manner similar to the live game, except that the electronic device 300 replaces the dealer. A player places a gaming token into the ante/bet coin acceptor 340 and presses the deal button 350. This activates the electronic device 300 and the player's five card hand and the dealer's five card hand appear on the video display screen 310. Each of the cards 311, 312, 313, 314 and 315 of the player's hand are displayed face up. The first card 316 of the dealer's hand is displayed face up while the remaining cards 317, 318, 319 and 320 of the dealer's hand are displayed face down. The player evaluates his hand and decides whether to continue to play or not, i.e., to bet or fold. If the player wishes to fold, the player presses the fold button 357 and the game is over.

If the player wishes to continue to play, he places a number of gaming tokens equal to twice his ante into the ante/bet coin acceptor 340 and presses the deal button 350. This causes the four remaining face down dealer's cards 317, 318, 319 and 320 to be displayed face up. If the dealer's hand has less than an Ace-King combination, the player automatically wins and the player is paid 1 to 1 odds on the amount of his ante and the amount of his bet is returned to him. This payoff is made by incrementing the credit LED display 334 by the number of units which the player has won.

If the dealer has at least an Ace-King combination, then the higher poker hand between the player and the dealer wins. If the player wins, the credit LED display 334 is incremented by the amount that the player wins using the same pay off schedule, including the bonus payments, as is used in the live game.

If the player wishes to utilize the credits displayed on the credit LED 334 to make antes or bets on subsequent hands, he can do so by pressing the ante credits button 352 or the bet credits button 354. The electronic device 300 can be programmed to limit the number of tokens that can be anted on a single hand to say five and the number of tokens, which can be bet to twice the number anted, say a maximum of ten. At the conclusion of any hand, the player can cause the electronic device to pay out the number of tokens shown on the credit LED 334 by pressing the cash out button 358. The number of tokens pay out is shown on the paid out LED display 336.

At the beginning of play, in addition to making an ante, a player can also elect to participate in the progressive jackpot component by placing a gaming token in the progressive jackpot coin acceptor 342 and pushing the jackpot bet button 356. In order to allow a player to select one of the three wagering options consisting of (1) underlying card game only, (2) progressive jackpot only, or both underlying game and jackpot, the jackpot bet credits buttons 356 may be depressed 0, 1, or 2 times by the player. For example, if the player wants to participate in only the underlying game, then button 356 is not pushed. If the player wishes to participate in both the game and jackpot, the button 356 is pushed once. To select jackpot only mode, the player pushes button 356 twice. Depression of the button 356, coupled with token insertion or a positive credit balance, activates the progressive jackpot indicator light 326. If a player is dealt one of the predetermined winning hands, the player wins a predetermined amount of the progressive jackpot. If the winning amount is a fixed number of tokens, that amount is automatically added to the amount shown on the credit LED display 334. If the winning amount is a percentage of the amount shown on a progressive meter (not shown) to which the electronic device is connected, then the player is manually paid by the casino personnel.

Instead of manually inserting gaming tokens into the progressive jackpot coin acceptor 342, a player may press the progressive jackpot bet button 356 in which case a unit is deducted from the credit LED display 334 and the progressive jackpot indicator light 326 is activated. As a player convenience feature, activation of a "change" button 362 illuminates a light 364 disposed atop the device 300 for the purpose of summoning a casino employee to make change for other otherwise assist the player.

The Caribbean Stud electronic video game version is played essentially in the same manner as the live casino table version, with the following exception. Due to the fact that the cards are dealt on the video screen, as opposed to the player being able to pick up the cards, the player can not change the order of the cards on the screen. This allows for the addition of sequential jackpots. Taking card sequence into account, the odds of a Diamond Sequential Royal Flush Hand coming up are 311,875,200 to 1. If 5000 machines are played full time with 100% jackpot participation by the players and linked to the same progressive jackpot, then a Diamond Sequential Royal Flush jackpot will occur, on the average, every 14.44 days, with an average final jackpot of about $11,385,477. These figures assume that each player must wager $0.25 to participate in the progressive jackpot, with 96% of each jackpot wager going to the jackpot meter and the other 4% going to the house. Under these conditions, calculations show that the brake even point on a jackpot bet is reached when the jackpot exceeds about $14,404,229. Once the jackpot exceeds this value, it is profitable for the smart player to play the jackpot, since the payoff odds more than compensate for the odds against obtaining the winning hand. If, to play the jackpot, the player must play the underlying game and give up an additional 5.3% to the house, the break even jackpot amount increases to about $15,167,653.

The major modification involved in implementing the jackpot only mode in existing electronic Caribbean Stud TM poker, video poker, and Twenty-One games consists of revision of the software. The software modification causes cards to be dealt only to the player, and not to the "dealer" when the player selects jackpot only mode operation. Since the dealers cards are not considered for the jackpot play, the dealers cards need not be dealt. The merit of the player's hand is judged only by its jackpot value, and paid accordingly.

Tests have shown that the maximum rate of play per hour increases from 360 hands/hour for the standard Caribbean Stud electronic video game version, to approximately 1200 hands/hour for the jackpot only mode of play. The great increase in the rate of play results from the fact that dealers cards are not dealt nor turned, no player decisions need to be made, and no bonuses are paid. The percentage profit on an annuity for a standard jackpot is 5.57% after subtracting out a $100,000 seed, for each quarter bet into the jackpot. This is in addition to a 4% rake on the jackpot. The win of the underlying Caribbean Stud game is 5.295%. Thus, by invoking the jackpot only mode, the average player's losses per hand decreases from a maximum of 14.865% when the standard mode is played, to 9.57% when the jackpot only mode is used. This is advantageous to the player when the jackpot amount exceeds the break even point set forth above. The advantage to the house is that the rate of play increases 333%, so that the over all revenues or win is increased to an equivalent of 31.86% for the same amount of time, as compared to the 14,865% of the game plus jackpot mode.

As a further alternative in either the live game or the electronic game, rather than the dealer receiving one card up and four cards down, the dealer may receive two cards up and three down. This would slightly vary the odds in favor of the player. The odds could be varied more toward the dealer by having the dealer receive all of his cards face down. Other variations or modifications will be apparent to those skilled in the art. Accordingly, the invention should not be limited by the foregoing description, but rather should be defined only by the following claims.

What is claimed is:

1. An electronic device for playing a casino card game including a progressive jackpot component, comprising:

means for allowing a player to select one of three wagering options consisting of (1) placing a wager to participate only in the underlying card game, (2) placing a wager to participate only in the progressive jackpot component, and (3) placing wagers to participate in both the underlying card game and the progressive jackpot component;

means for electronically simulating and displaying to a player both player and dealer card hands if the player selects wagering option (1) or (3) and displaying only a player card hand if the player selects wagering option (2);

means for electronically comparing the player hand against the dealer hand according to predetermined game rules to determine the winning hand;

means for settling the wager in the underlying card game only if the player selects wagering option (1) or (3);

means for electronically determining if the player hand corresponds to one or more predetermined winning card arrangements; and means for settling the wager in the progressive jackpot component only if the player selects wagering option (2) or (3).

2. The electronic device of claim 1, wherein the underlying casino card game comprises Twenty-One.

3. The electronic device of claim 2, wherein the underlying casino card game comprises Caribbean Stud TM poker.

4. The electronic device of claim 1, wherein said means for allowing a player to select one of three wagering options comprises at least one push button.

5. An electronic device for playing a casino card game including a progressive jackpot component, comprising:

means for allowing a player to select one of at least two wagering options comprising of (1) placing a wager to participate only in the progressive jackpot component, and (2) placing wagers to participate in both the underlying card game and the progressive jackpot component;

means for electronically simulating and displaying to a player both player and dealer card hands if the player selects wagering option (2) and displaying only a player card hand if the player selects wagering option (1);

means for electronically comparing the player hand against the dealer hand according to predetermined game rules to determine the winning hand;

means for settling the wager in the underlying card game only if the player selects wagering option (2);

means for electronically determining if the player hand corresponds to one or more predetermined winning card arrangements; and means for settling the wager in the progressive jackpot.

6. The electronic device of claim 5, wherein the underlying casino card game comprises Twenty-One.

7. The electronic device of claim 5, wherein the underlying casino card game comprises Caribbean Stud TM poker.

8. The electronic device of claim 5, wherein said means for allowing a player to select one of at least two wagering options comprises at least one push button.

9. A method of playing an electronic simulation of a casino card game including a progressive jackpot component on an electronic device comprising the steps of:

allowing a player to select one of three wagering options consisting of (1) placing a wager to participate only in the underlying card game, (2) placing a wager to participate only in the progressive jackpot component, and (3) placing wagers to participate in both the underlying card game and the progressive jackpot component;

electronically simulating and displaying to a player both player and dealer card hands if the player selects wagering option (1) or (3) and displaying only a player card hand if the player selects wagering option (2);

electronically comparing the player hand against the dealer hand according to predetermined game rules to determine the winning hand and settling the wager in the underlying card game only if the player selects wagering option (1) or (3); and electronically determining if the player hand corresponds to one or more predetermined winning card arrangements and settling the wager in the progressive jackpot component only if the player selects wagering option (2) or (3).

10. The electronic device of claim 9, wherein the underlying casino card game comprises Twenty-One.

11. The electronic device of claim 9, wherein the underlying casino card game comprises Caribbean Stud TM poker.

12. A method of playing an electronic simulation of a casino card game including a progressive jackpot component on an electronic device comprising the steps of:

allowing a player to select one of at least two wagering options consisting of (1) placing a wager to participate only in the progressive jackpot component, and (2) placing wagers to participate in both the underlying card game and the progressive jackpot component;

electronically simulating and displaying to a player both player and dealer card hands if the player selects wagering option (2) and displaying only a player card hand if the player selects wagering option (1);

electronically comparing the player hand against the dealer hand according to predetermined game rules to determine the winning hand and settling the wager in the underlying card game only if the player selects wagering option (2); and electronically determining if the player hand corresponds to one or more predetermined winning card arrangements and settling the wager in the progressive jackpot component.

13. The method of claim 12, wherein the underlying casino card game comprises Twenty-One.

14. The method of claim 12, wherein the underlying casino card game comprises Caribbean Stud TM poker.

15. Apparatus for including a progressive jackpot component in a live casino card table game, comprising:

a gaming table having a plurality of player locations at which a player receives playing cards from a dealer;

means associated with each player location for the player to select one of three wagering options consisting of (1) placing a wager to participate only in the underlying card game, (2) placing a wager to participate only in the progressive jackpot component, and (3) placing wagers to participate in both the underlying card game and the progressive jackpot component;

means for indicating on a jackpot meter the amount in the jackpot; and means for decreasing the amount shown on the jackpot meter by the amount won by a player if the player achieves a predetermined arrangement of the playing cards only if the player has elected wagering option (2) or (3).

16. The apparatus of claim 15, further comprising means for providing a positive indication of a selection by a player of wagering option (2).

17. The apparatus of claim 16, wherein said means for providing a positive indication comprises a light.

18. Apparatus for including a progressive jackpot component in a live casino card table game, comprising:

a gaming table having a plurality of player locations at which a player receives playing cards from a dealer;

means associated with each player location for the player to select one of at least two wagering options consisting of (2) placing a wager to participate only in the progressive jackpot component, and (3) placing wagers to participate in both the underlying card game and the progressive jackpot component;

means for indicating on a jackpot meter the amount in the jackpot; and means for decreasing the amount shown on the jackpot meter by the amount won by a player if the player achieves a predetermined arrangement of the playing cards.

19. The apparatus of claim 18, further comprising means for providing a positive indication of a selection by a player of wagering option (2).

20. The apparatus of claim 19, wherein said means for providing a positive indication comprises a light.

* * * * *

US005377973B1

REEXAMINATION CERTIFICATE (3077th)

United States Patent [19] [11] B1 5,377,973

Jones et al. [45] Certificate Issued Dec. 10, 1996

[54] METHODS AND APPARATUS FOR PLAYING CASINO CARD GAMES INCLUDING A PROGRESSIVE JACKPOT

[75] Inventors: Daniel A. Jones, Las Vegas, Nev.; Mark W. Duron, Ft. Lauderdale, Fla.

[73] Assignee: D & D Gaming Patents, Inc., Pompano Beach, Fla.

Reexamination Request:
No. 90/004,109, Dec. 29, 1995

Reexamination Certificate for:

| | |
|---|---|
| Patent No.: | **5,377,973** |
| Issued: | **Jan. 3, 1995** |
| Appl. No.: | **195,482** |
| Filed: | **Feb. 14, 1994** |

Related U.S. Application Data

[63] Continuation-in-part of Ser. No. 140,688, Oct. 21, 1993, Ser. No. 40,925, Mar. 31, 1993, Ser. No. 74,301, Jun. 9, 1993, and Ser. No. 88,785, Jul. 8, 1993, said Ser. No. 40,925, said Ser. No. 74,301, said Ser. No. 88,785, Jul. 8, 1993, is a continuation-in-part of Ser. No. 800,631, Nov. 27, 1991, Pat. No. 5,288,077, said Ser. No. 140,688, Oct. 21, 1993, is a continuation-in-part of Ser. No. 74,301, Jun. 9, 1993, which is a continuation-in-part of Ser. No. 800,631, Jun. 9, 1993, which is a continuation-in-part of Ser. No. 361,276, Jun. 5, 1989, Pat. No. 5,078,405, which is a division of Ser. No. 214,934, Jul. 5, 1988, Pat. No. 4,861,041, which is a continuation-in-part of Ser. No. 182,374, Apr. 18, 1988, Pat. No. 4,836,553.

[51] Int. Cl.[6] ..... A63F 1/00

[52] U.S. Cl. ..... 463/12; 463/13; 463/27; 273/292; 273/309

[58] Field of Search ..... 273/292, 274, 273/309; 463/12, 13, 26, 27

[56] References Cited

U.S. PATENT DOCUMENTS

| | | | |
|---|---|---|---|
| D. 105,610 | 8/1937 | **Posey** | D6/618 |
| D. 118,451 | 8/1939 | **Radford** | D21/26 |
| D. 183,007 | 6/1958 | **Lord** | D21/26 |
| D. 213,891 | 4/1969 | **Schultz** | D21/32 |
| D. 220,635 | 5/1971 | Boyer et al. | D21/30 |
| D. 245,717 | 9/1977 | Jessie | D21/32 |

(List continued on next page.)

FOREIGN PATENT DOCUMENTS

| | | |
|---|---|---|
| 621599 | 4/1989 | Australia . |
| 628044 | 4/1989 | Australia . |
| 96049 | 4/1989 | Austria . |
| 1334983 | 3/1995 | Canada . |
| 1335381 | 4/1995 | Canada . |
| 4792 | 6/1991 | Dominican Rep. . |

(List continued on next page.)

OTHER PUBLICATIONS

Winning Gamer, Issue #5, Feb. 1985, Pi Yee Press, LaJolla, CA.

Winning Gamer, Issue #6, Mar. 1985, Pi Yee Press, LaJolla, CA.

Winning Gamer, Issue #15, Dec. 1985, Pi Yee Press, LaJolla, CA.

Winning Gamer, Issue #19, Apr. 1986, Pi Yee Press, LaJolla, CA.

(List continued on next page.)

*Primary Examiner*—Benjamin H. Layno

[57] ABSTRACT

Methods and apparatus for allowing gamblers playing either live casino table game or electronic video device versions of card games allow the players the options of (1) making wagers in both the underlying card game and a progressive jackpot component, (2) making wagers only in the underlying card game, and (3) making a wager only in the progessive jackpot component. In the live table version, a player may activate an indicator light or place a special token in the bet box for the underlying game to signal that the player opts to participate only in the progressive jackpot component. In the electronic video device version, a player activates one or more push buttons to select one of the three operational modes. The underlying card game preferably comprises Twenty-One or a five-card stud poker variant known as Caribbean Stud ™ poker, but may also comprise other card games such as five card stud, seven card stud, Jacks or better, etc.

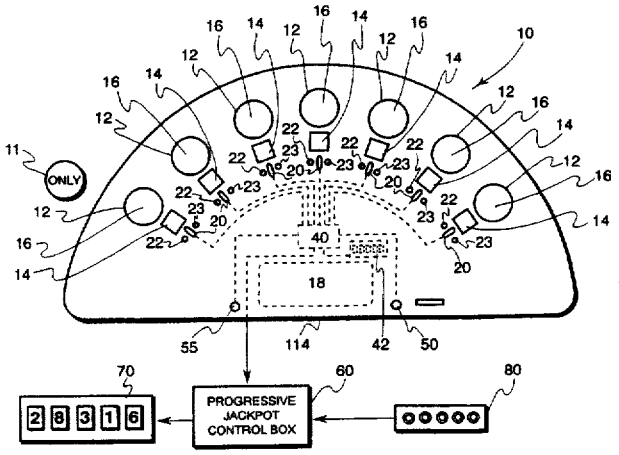

U.S. PATENT DOCUMENTS

| | | | |
|---|---|---|---|
| D. 263,975 | 4/1982 | Quiroga et al. | D21/37 |
| D. 311,474 | 10/1990 | Hoffman | D6/618 |
| 1,238,736 | 9/1917 | Barrett | 453/18 |
| 1,527,929 | 6/1924 | Simons | 273/274 |
| 1,763,476 | 6/1930 | Morris | 273/309 |
| 1,970,876 | 4/1933 | Anderson | 273/309 |
| 2,008,829 | 10/1935 | Israel | 273/148 A |
| 2,199,745 | 5/1940 | Harris | 273/309 |
| 3,011,789 | 12/1961 | Eliassen et al. | 273/274 |
| 3,269,503 | 8/1966 | Foster | 463/26 |
| 3,556,531 | 1/1971 | Elder | 273/143 R |
| 3,663,021 | 5/1972 | Whippo | 273/296 |
| 3,667,757 | 6/1972 | Holmberg | 273/274 |
| 3,689,071 | 9/1972 | Kucera | 273/292 |
| 3,796,433 | 3/1974 | Fraley et al. | 463/12 |
| 3,825,255 | 7/1974 | Kennard et al. | 273/139 |
| 3,874,671 | 4/1975 | Smith | 273/254 |
| 3,876,208 | 4/1975 | Wachtler et al. | 463/13 |
| 4,063,680 | 12/1977 | Leo | 232/10 |
| 4,099,722 | 7/1978 | Rodesch et al. | 273/143 R |
| 4,232,866 | 11/1980 | Pennachio | 273/374 |
| 4,302,012 | 11/1981 | Di Giovanni et al. | 273/148 R |
| 4,305,586 | 12/1981 | Richards | 273/274 |
| 4,364,567 | 12/1982 | Goott | 273/237 |
| 4,397,469 | 8/1983 | Carter, III | 273/149 R |
| 4,518,001 | 5/1985 | Branham | 133/5 R |
| 4,531,187 | 7/1985 | Uhland | 364/412 |
| 4,575,085 | 3/1986 | Ollington | 273/138.1 |
| 4,614,342 | 9/1986 | Takashima | 463/11 |
| 4,624,459 | 11/1986 | Kaufman | 273/143 R |
| 4,648,604 | 3/1987 | Horan | 273/292 |
| 4,651,997 | 3/1987 | Wood | 273/274 |
| 4,700,948 | 10/1987 | Okada | 273/143 R |
| 4,721,307 | 1/1988 | Okada | 273/143 R |
| 4,743,022 | 5/1988 | Wood | 463/13 |
| 4,756,531 | 7/1988 | DiRe et al. | 463/18 |
| 4,759,549 | 7/1988 | Beckwith | 273/274 |
| 4,760,527 | 7/1988 | Sidley | 463/13 |
| 4,813,675 | 3/1989 | Greenwood | 463/46 |
| 4,836,546 | 6/1989 | DiRe et al. | 463/18 |
| 4,836,553 | 6/1989 | Suttle et al. | 273/292 |
| 4,837,728 | 6/1989 | Barrie et al. | 364/412 |
| 4,861,041 | 8/1989 | Jones et al. | 273/292 |
| 4,948,134 | 8/1990 | Suttle et al. | 463/13 |
| 4,964,638 | 10/1990 | Ishida | 463/27 |
| 5,007,519 | 4/1991 | Mercurio | 194/230 |
| 5,022,653 | 6/1991 | Suttle et al. | 463/13 |
| 5,042,818 | 8/1991 | Weingardt | 273/292 |
| 5,078,405 | 1/1992 | Jones et al. | 273/309 |
| 5,098,107 | 3/1992 | Boylan et al. | 273/292 |
| 5,112,060 | 5/1992 | Jones | 273/309 |
| 5,249,800 | 10/1993 | Hilgendorft et al. | 463/27 |
| 5,257,810 | 11/1993 | Schorr et al. | 273/292 |
| 5,275,400 | 1/1994 | Weingardt et al. | 463/12 |
| 5,277,424 | 1/1994 | Wilms | 463/12 |
| 5,288,077 | 2/1994 | Jones | 273/292 |
| 5,288,081 | 2/1994 | Breeding | 273/292 |
| 5,364,104 | 11/1994 | Jones et al. | 273/292 |
| 5,364,105 | 11/1994 | Jones | 273/292 |
| 5,374,067 | 12/1994 | Jones | 273/292 |
| 5,377,973 | 1/1995 | Jones | 273/292 |
| 5,377,994 | 1/1995 | Jones | 273/309 |
| 5,380,012 | 1/1995 | Jones | 273/292 |
| 5,382,025 | 1/1995 | Sklansky et al. | 273/292 |
| 5,393,067 | 2/1995 | Paulsen et al. | 273/292 |

FOREIGN PATENT DOCUMENTS

| | | |
|---|---|---|
| 4793 | 6/1991 | Dominican Rep. . |
| 4825 | 3/1993 | Dominican Rep. . |
| 4999 | 8/1993 | Dominican Rep. . |
| 2830216 | 1/1980 | Germany . |
| 3003376 | 8/1981 | Germany . |
| 68909992 | 4/1989 | Germany . |
| 0338644 | 4/1989 | Italy . |
| 135187 | 6/1988 | Japan . |
| 2097570 | 4/1982 | United Kingdom . |
| 2169736 | 7/1986 | United Kingdom . |
| 2184029 | 6/1987 | United Kingdom . |
| 9220417 | 11/1992 | WIPO . |
| 9310869 | 6/1993 | WIPO . |
| 9415684 | 7/1994 | WIPO . |
| 9521665 | 8/1995 | WIPO . |

OTHER PUBLICATIONS

Winning Gamer, Issue #20, May 1986, PI Yee Press, LaJolla, CA.

Winning Gamer, Issue #21, Jun. 1986, Pi Yee Press, LaJolla, CA.

Affidavit Of John F. Acres, Oct. 4, 1993.

Affidavit Of William Randall Adams, Oct. 4, 1993.

Affidavit Of Derell M. Johns, Nov. 19, 1993.

Affidavit Of Terry Oliver, Nov. 22, 1993.

Affidavit Of Nick Edward Greenwood, Nov. 23, 1993.

Affidavit Of Michael Spencer Stone, Nov. 23, 1993.

Scarne, Scarne's Encyclopedia Of Games, Harper & Row, N.Y., Copyright 1973, pp. 381, 383 and title pages.

Scarne, Scarne's Encyclopedia Of Games, Harper & Row, N.Y. Copyright 1973, pp. 33–41 and title pages.

Scarne, Scarne's New Complete Guide to Gambling, Simon & Schuster, N.Y., Copyright 1961, pp. 450–445 and title pages.

Scarne, Scarne's Encyclopedia Of Card Games, Harper & Row, N.Y., Copyright 1983, pp. 299–304, 383, and title pages.

W. B. Gibson, Hoyle's Modern Encyclopedia Of Card Games, pp. 218–219, 369–370 (1974).

Casino Player, vol. IV, No. 12, Aug. 1993, "My Biggest Slot Jackpot", Stanford Wong.

Gaming Concepts, Inc. "Over/Under 13 Blackjack" brochure, 1988.

Casino Journal, vol. 8, No. 12, Dec. 1992, "Working Within The System: IGT's Linked progressive programs take leap to the tables", pp. 10–15, 40, 41.

Casino Gaming, Sep. 1988, "Aruba Deals A New Game: Caribbean Stud Poker", pp. 12–13.

Casino Journal, vol. 8, No. 6, Jun. 1993, "So You Wanna Be A Gambler", pp. 1, 5.

Information Disclosure Statement, Apr. 7, 1988, Describing "Sklansky's Casino Poker and Video Poker" Coin Hopper Model CH–500 and Model No. DH–750/U1 Literature Asahi Seiko.

26 Jan. 1993 Statement Of Grounds And Particulars, By John Huxley Ltd., In Opposition To Australian In Opposition To Australian Patent Application No. 628044.

State of New Jersey Casino Control Commission PRN 217205 Civil Action, IGT's Second Amended Petition For Authorization For The Implementation Of The Game Of Progressive 21, filed sometime after Aug. 4, 1992.

Review Journal, "Gamblers Take Chance At Million Dollar Payoff", By C. J. Boyer Winning Gamer, Issue #17, Feb. 1986, Pi Yee Press, LaJolla, CA.

Scarne, Scarne's Encyclopedia Of Games, "Hold 'Em", Harper & Row Publishers, Copyright 1973, pp. 14–18, 26 Abercrinbue & Fitch, Play Hours, 1960, p. 11, Blackjack Towel.

Scarne, Scarne's Encyclopedia Of Card Games, copyright date unknown, p. 288.
Jim Kilby's Declaration Under 37 C.F.R. & 1.132.
TXU 184,603, Mar. 30, 1985.
TX 2,568,066, Mar. 6, 1989.
Scarne, Scarne's Guide To Modern Poker, copyright unknown, pp. 40, 60–61.
Request For Reexamination, U.S. Pat. No. 4,861,041; issued Aug. 29, 1989; Date of Service: Jun. 20, 1995.
Request For Reexamination, U.S. Pat. No. 4,861,041; issued Aug. 29, 1989; Date of Service: Sep. 2, 1993.
Request For Reexamination, U.S. Pat. No. 5,288,077, issued Feb. 22, 1994; Date of Service May, 26, 1995.
Request For Reexamination, U.S. Pat. No. 5,364,105, issued Nov. 15, 1994; Date of Service May, 26, 1995.
Asahi Seiko Catalog No. AV89C, Aug. 20, 1989, pp. 44, 51 and Photograph "A".
Scarne, Scarne's Encyclopedia Of Games, Copyright 1973, pp. 11, 31, 440–445.
Declaration of I. Nelson Rose, dated Jan. 26, 1989.
Declaration of Don Clark, dated Feb. 2, 1989.
Declaration of Dennis Robie, dated Jan. 27, 1989.
Declaration of Mark A. Sincox, dated Feb. 7, 1989.
Declaration of John Edward Roethel, dated Feb. 7, 1989.
Scarne, Scarne's Encyclopedia of Games, Harper & Row, Copyright 1973, title pages and pp. 33–37.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–20 is confirmed.

* * * * *